US006951765B1

(12) United States Patent
Gopinath et al.

(10) Patent No.: US 6,951,765 B1
(45) Date of Patent: Oct. 4, 2005

(54) METHOD AND APPARATUS FOR INTRODUCTION OF SOLID PRECURSORS AND REACTANTS INTO A SUPERCRITICAL FLUID REACTOR

(75) Inventors: Sanjay Gopinath, Fremont, CA (US); Patrick A. Van Cleemput, Sunnyvale, CA (US); Michelle Schulberg, Palo Alto, CA (US); Sasangan Ramanathan, San Ramon, CA (US); Francisco Juarez, Fremont, CA (US); Patrick Joyce, San Jose, CA (US)

(73) Assignee: Novellus Systems, Inc., San Jose, CA (US)

( * ) Notice: Subject to any disclaimer, the term of this patent is extended or adjusted under 35 U.S.C. 154(b) by 446 days.

(21) Appl. No.: 10/016,017

(22) Filed: Dec. 12, 2001

(51) Int. Cl.[7] ..... B08B 13/00

(52) U.S. Cl. ..... 438/5; 438/5; 438/14; 134/1.3; 134/56

(58) Field of Search ..... 438/689, 704, 438/5, 14; 134/105, 108, 109, 26, 1.3, 1.2, 134/56 R; 137/12, 557; 138/5; 417/36, 38; 210/97, 137, 143

(56) References Cited

U.S. PATENT DOCUMENTS 5,403,089 A * 4/1995 Kuo et al. ..... 366/132
5,725,672 A * 3/1998 Schmitt et al. ..... 118/715
6,056,994 A * 5/2000 Paz de Araujo et al. ..... 427/96
6,149,828 A * 11/2000 Vaartstra ..... 216/57
6,176,930 B1 * 1/2001 Koai et al. ..... 118/715
6,550,484 B1 * 4/2003 Gopinath et al. ..... 134/1.2
6,715,498 B1 * 4/2004 Humayun et al. ..... 134/1.3
6,764,552 B1 * 7/2004 Joyce et al. ..... 134/3
6,766,810 B1 * 7/2004 Van Cleemput ..... 134/1.3
6,782,900 B2 * 8/2004 DeYoung et al. ..... 134/105
6,800,142 B1 * 10/2004 Tipton et al. ..... 134/26
6,805,801 B1 * 10/2004 Humayun et al. ..... 210/663
2001/0050096 A1 12/2001 Costantini et al.
2002/0014257 A1 2/2002 Chandra et al.
2002/0046707 A1 4/2002 Biberger et al.
2003/0121799 A1 * 7/2003 Stevens et al. ..... 205/775
2004/0065547 A1 * 4/2004 Stevens et al. ..... 204/405

* cited by examiner

*Primary Examiner*—Laura M Schillinger
(74) *Attorney, Agent, or Firm*—Beyer Weaver & Thomas LLP

(57) ABSTRACT

The present invention pertains to apparatus and methods for introduction of solid precursors and reactants into a supercritical fluid reactor. Solids are dissolved in supercritical fluid solvents in generator apparatus separate from the supercritical fluid reactor. Such apparatus preferably generate saturated solutions of solid precursors via recirculation of supercritical fluids through a vessel containing the solid precursors. Supercritical solutions of the solids are introduced into the reactor, which itself is charged with a supercritical fluid. Supercritical conditions are maintained during the delivery of the dissolved precursor to the reactor. Recirculation of supercritical precursor solutions through the reactor may or may not be implemented in methods of the invention. Methods of the invention are particularly well suited for integrated circuit fabrication, where films are deposited on wafers under supercritical conditions.

15 Claims, 5 Drawing Sheets

METHOD AND APPARATUS FOR INTRODUCTION OF SOLID PRECURSORS AND REACTANTS INTO A SUPERCRITICAL FLUID REACTOR

FIELD OF THE INVENTION

This invention relates to methods and apparatus for forming layers on substrates. More particularly, it relates to methods and apparatus that use supercritical fluids as mediums both to dissolve and carry solid precursors to a reactor where they are used to form layers on wafers.

BACKGROUND OF THE INVENTION

Supercritical fluids or solutions exist when the temperature and pressure of a solution are above its critical temperature and pressure. In this state, there is no differentiation between the liquid and gas phases and the fluid is referred to as a dense gas in which the saturated vapor and saturated liquid states are identical. Near supercritical fluids or solutions exist when the reduced temperature and pressure of a solution are both greater than 80% of their critical point but the solution is not yet in the supercritical phase. Due to their high density, supercritical and near supercritical fluids possess superior solvating properties.

Supercritical fluids have been used in thin film processing as developer reagents or extraction solvents. Morita et al. (U.S. Pat. Nos. 5,185,296 and 5,304,515) describe a method in which supercritical fluids are used to remove unwanted organic solvents and impurities from thin films deposited on substrates. Allen et al. (U.S. Pat. No. 5,665,527) describe a high resolution lithographic method in which a supercritical fluid is used to selectively dissolve a soluble unexposed portion of polymeric material from a substrate, thereby forming a patterned image. In recognition of the superior solvating properties of supercritical fluids, Steckle et al. (U.S. Pat. No. 5,710,187) describe a method for removing impurities from highly cross-linked nanoporous organic polymers.

Methods for depositing thin films using supercritical fluids also have been reported. Murthy et al. (U.S. Pat. No. 4,737,384) describe a method for depositing metals and polymers onto substrates using supercritical fluids as the solvent medium. Sievers et al. (U.S. Pat. No. 4,970,093) describe a chemical vapor deposition method (CVD), in which a supercritical fluid is used to dissolve and deliver a precursor in aerosol form to a conventional CVD reactor. Watkins et al. (U.S. Pat. No. 5,789,027) describe a method termed Chemical Fluid Deposition (CFD) for depositing a material onto a substrate surface. In this method a supercritical fluid is used to dissolve a precursor of the material to be deposited. Once dissolved, a reaction reagent is introduced that initiates a chemical reaction involving the precursor, thereby depositing the material onto the substrate.

Although the above mentioned methods take advantage of supercritical fluids as mediums for reagent transport, reaction, and removal of impurities, what is lacking in the art are more reliable and practical apparatus and methods of using them. Conventional methods and apparatus that use supercritical fluids for depositing films on substrates involve batch type processes, where a substrate and a precursor or reactant are placed in a reactor. The reactor is then charged with a supercritical fluid. In this way, the precursor or reactant is dissolved and the substrate exposed to the supercritical solution. Once the deposition (or other) reaction is complete the reactor is vented and the substrate removed.

Such methods and apparatus are especially problematic when the precursor or reactant is a solid. Often times it is either difficult to dissolve the solid properly within the reactor, or the deposition is not uniform due to obligatory dissolution of the precursor in the presence of the substrate. This dissolution often involves heating the precursor which can cause side reactions, which may form unwanted impurities on the substrate or in the deposited layer thereon.

What is therefore needed are improved apparatus and methods for introduction of solid precursors and reactants into a supercritical fluid reactor. In particular, what is needed are apparatus that deliver preformed solutions of solid precursors and reactants to supercritical fluid reactors.

SUMMARY OF THE INVENTION

The present invention pertains to apparatus and methods for introduction of solid precursors and reactants into a supercritical fluid reactor. More specifically, solids are dissolved in supercritical fluid solvents in generator apparatus separate from the supercritical fluid reactor. Such apparatus preferably generate saturated solutions of solid precursors via recirculation of supercritical fluids through a vessel containing the solid precursors. Supercritical solutions of the solids are introduced into the reactor, which itself is charged with a supercritical fluid. Supercritical conditions are maintained during the delivery of the dissolved precursor to the reactor. Recirculation of supercritical precursor solutions through the reactor may or may not be implemented in methods of the invention. Methods of the invention are particularly well suited for integrated circuit fabrication, where films are deposited on wafers under supercritical conditions.

Thus, one aspect of the invention is an apparatus for providing a solid precursor to a surface of a work piece via a supercritical solution. Such an apparatus may be characterized by the following features: a plurality of vessels for housing the solid precursor and allowing it to contact a solvent under supercritical or near supercritical conditions to produce a solution of the solid precursor; a generator recirculation loop communicating with the plurality of vessels and allowing the solution of the solid precursor to recirculate through the plurality of vessels, said solution being under supercritical or near supercritical conditions over its entire recirculation path, and a delivery mechanism adapted to deliver, under supercritical or near supercritical conditions, a portion of the solution to a reactor for housing said work piece. Preferably the solid precursor is a solid at or about standard temperature and pressure.

Such apparatus are particularly useful for making solutions of a precursor. Preferably such a solution is a saturated solution which is further diluted, for use in depositing a layer of the precursor on the wafer work surface or in some cases for use in cleaning or otherwise treating a wafer work surface. For example, the saturated solution is metered into a known quantity of supercritical fluid in the reactor (the volume of which may make up a portion of the total volume of a reactor recirculation loop) to make a diluted solution of known concentration. Metering is preferably performed via a plurality of syringe pumps. Preferably, the generator recirculation loop includes a pump for providing fluid flow and a valve for causing at least some fraction of the solvent to circulate through the plurality of vessels housing the solid precursor to ensure production of the saturated solution.

Even more preferably, a dilution mechanism is used to produce a diluted solution of the solid precursor from a saturated solution, and the diluted solution is further diluted by metering it into the reactor (and/or reactor recirculation loop) as described above. Preferably such a dilution mechanism includes the same plurality of syringe pumps as the delivery mechanism. Since a plurality of vessels and syringe pumps are used, change out of precursor loads or malfunctioning equipment does not slow progress in a production setting.

As mentioned, apparatus of the invention preferably have a reactor recirculation loop configured to allow recirculation of the diluted solution through the reactor under supercritical or near supercritical conditions. To augment the loop, apparatus further include a fluid inlet, coupled to the reactor, for supplying supercritical fluids to the reactor; and a first bleed valve, located downstream from the reactor. With these two elements, in conjunction with, for example, one-way valves appropriately positioned in the reactor recirculation loop, apparatus of the invention allow flushing of the reactor while maintaining the majority of the volume of the system to remain charged with supercritical fluid media. To add even more flexibility, the apparatus may further include a by-pass line configured to allow isolation of the reactor from the reactor recirculation loop. In this way, either the reactor or the reactor recirculation loop may be vented independently, thus saving on materials and downtime. Additional embodiments and specific details are described in the detailed description below.

In accord with the apparatus of the invention, another aspect of the invention is a method of forming a layer on a work piece. Such methods can be characterized by the following sequence: (a) providing the work piece to a reactor; (b) providing a solvent in the reactor under supercritical or near supercritical conditions; (c) introducing a supercritical solution of a dissolved precursor to the reactor, while maintaining supercritical or near supercritical conditions in the reactor; and (d) allowing the precursor to form a layer on the work piece. Preferably, the precursor is a solid at or about standard temperature and pressure. Also preferably (b)–(d) are repeated for a second dissolved precursor to form a second layer on top of the first layer. Preferably, (b) includes introducing the solvent under non-supercritical conditions, and transitioning to supercritical conditions in the reactor. Thus (c) preferably includes maintaining substantially constant pressure during introduction of the dissolved precursor, to thereby reduce the likelihood that the precursor will precipitate from the solution. Also preferably (c) includes maintaining substantially constant temperature during introduction of the dissolved precursor.

Preferably the supercritical solution of the dissolved precursor is a dilute solution made from a saturated solution of the dissolved precursor. Preferably the saturated solution of the dissolved precursor is formed by allowing a corresponding precursor to contact a recirculating flow of the solvent, the solvent being under supercritical or near supercritical conditions over its entire recirculation path. Alternatively, a second solvent or solvents are used to generate the solution of dissolved precursor, the saturated solution, and the dilute solution. In one preferred method, once formed, the dilute solution is recirculated through the reactor during (b)–(d).

Also preferably the work piece is a wafer. Preferred layers for integrated circuit fabrication include but are not limited to a diffusion barrier, a conductive metal, a dielectric, an antireflective, an etch stop, a photoresist, a resistive, and an adhesion-seed layer. In one particularly preferred embodiment, the dielectric layer formed by methods of the invention is made of POSS-materials (polyhedral oligomeric silsesquioxanes). Preferably the POSS-materials include at least one of octavinyl-POSS, methacrylfluoro-3-POSS, and methacrylfluoro-13-POSS. Examples of suitable supercritical solvents for use with this invention include supercritical forms of at least one of carbon dioxide, ammonia, water, ethanol, ethane, propane, butane, pentane, dimethyl ether, hexafluoroethane, and mixtures thereof.

The supercritical solvents listed above may contain oxidants or reductants. In one preferred embodiment, the oxidants and reductants are in the form of gases dissolved in the supercritical solvent. Preferably oxygen (e.g. $O_2$) is used as an oxidant and hydrogen (e.g. $H_2$) as a reductant.

When more than one layer are to be deposited using methods of the invention, preferably the reactor is flushed with a supercritical fluid before repeating (c)–(d) to form a second layer. In a particular embodiment, related to integrated circuit fabrication, first a diffusion barrier is deposited on a wafer, and then a metal layer deposited thereon. Preferably the diffusion barrier material includes at least one of tantalum, tantalum nitride, titanium, titanium nitride, tungsten, tungsten nitride, cobalt, nickel, indium, tin, platinum, palladium, ruthenium oxide, and ruthenium. Also preferably the metal layer includes at least one of copper, aluminum, gold, silver, aluminum-copper, aluminum-silicon, and aluminum-silicon-copper. Preferably the copper and or silicon when alloyed with aluminum, between about 0.5 and 1% each of copper and silicon are used in the alloy.

Most preferably, the diffusion barrier is made of one of the materials listed above and the metal layer is a copper layer. In order to deposit diffusion barriers of the invention, preferable a dissolved precursor is delivered to the wafer and converted into one of the materials listed above in the deposition process. Preferably, such a precursor will include at least one of cobalt(II)acetonylacetonate, cobalt(II)tetramethyl-heptadionate, and tantalum(V)tetraethoxide-2,4-pentadionate. A precursor approach is also used to deposit metal layers of the invention. In the case of copper, preferably the dissolved precursor will include at least one of copper(II) tetramethylheptadionate, copper(II)trimethyloctanedionate, and copper(II)formate.

These and other features and advantages of the present invention will be described in more detail below with reference to the associated drawings.

DETAILED DESCRIPTION OF PREFERRED EMBODIMENTS

Figure 1A:
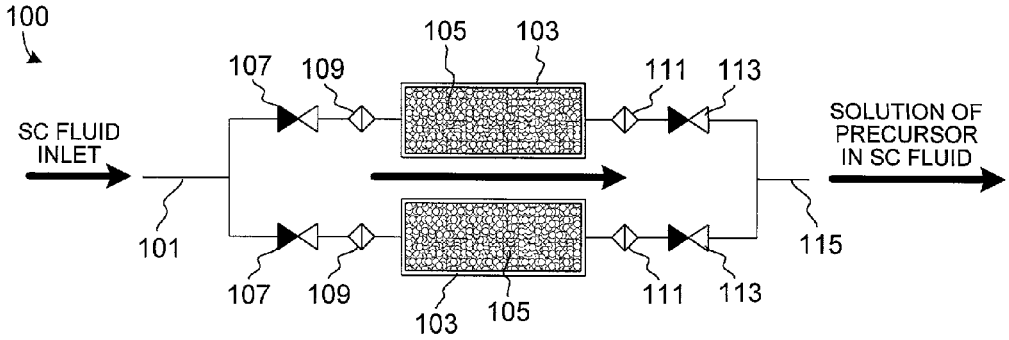
FIGS. 1A–B depict simplified block diagrams of apparatus for generating supercritical solutions of solid precursors in accordance with the invention.

In the following detailed description of the present invention, numerous specific embodiments are set forth in order to provide a thorough understanding of the invention. However, as will be apparent to those skilled in the art, the present invention may be practiced without these specific details or by using alternate elements or processes. For example, the invention is described in terms of methods and apparatus in relation to a supercritical fluid reactor for semiconductor wafer processing. The invention is not limited to semiconductor wafer processing. A substrate or work piece may be of various shapes, sizes, and materials. In addition to semiconductor wafers, other work pieces that may take advantage of this invention include various articles such as machine tools, weaponry, recording heads, recording media, storage medias, and the like. Also the invention is described generally in terms of depositing a precursor on a wafer, the invention can also be used for cleaning or otherwise treating wafers with supercritical solvent media. In some descriptions herein, well-known processes, procedures, and components have not been described in detail so as not to unnecessarily obscure aspects of the present invention.

In this application, the term wafer may be used interchangeably with partially fabricated integrated circuit. One skilled in the art would understand that the terms "wafer" and "partially fabricated integrated circuit" can refer to a silicon wafer during any of many stages of integrated circuit fabrication thereon. Preferably the invention is used as part of a Damascene process on a wafer using copper. However as mentioned, the invention is not so limited.

Also the term "precursor" is used. In this application, the term "precursor" means any solid precursor or reactant that is dissolved using supercritical fluids (solvents in this case). Generally, this means materials that are solids at standard temperature and pressure (STP), that is, twenty-five degrees Celcius and 760 torr. Thus a precursor can be for example a solid material that is dissolved in a supercritical fluid and deposited on a wafer, without changing the molecular structure of the material from its native form. Alternatively, a precursor can be a solid material that, when dissolved in a supercritical fluid and exposed to the wafer, is transformed or converted by a chemical reaction or modified in some way so as to become part of or incorporated into the product molecules of a deposited layer. Although supercritical fluids are used as solvents, one skilled in the art would understand that they also may serve other reagent roles, for example in part as catalysts for a particular reaction or other reaction mediators.

One skilled in the art would understand that apparatus described herein are constructed of heavy gauge stainless steel or other materials necessary to handle and control supercritical fluids. Such equipment may be able to withstand pressures of several thousand pounds per square inch and be resistant to the superior solvating properties of solvents when brought to supercritical conditions. Also, such equipment may be assembled from commercially available components or fabricated.

As outlined in the background section, conventional supercritical fluid reaction apparatus generally are "batch" type systems. This makes control of processes that take place in such reactors problematic, especially depositions, be they simple precipitations of dissolved solid precursors, or for example, polymerization of precursors via chemical reaction. That is, conventionally a supercritical reactor is charged with a solid precursor, a substrate, and a solvent, and then the system is brought to supercritical conditions to dissolve the precursor and achieve a result. The present invention allows much more flexibility and control than conventional systems by dissolving solid precursors before introduction into a supercritical reactor. This dissolution is done using a solvent under supercritical or near supercritical conditions. In some cases, this is done to avoid contamination by organic solvents (for example, a common problem in IC fabrication, especially with fluorinated solvents). In this way, the superior solvating properties of supercritical solvents are utilized and at the same time the use of traditional organic solvents is avoided.

Generally, the invention is embodied in apparatus and methods for dissolving solid precursors in supercritical media to create solutions of the precursors. Preferably the solutions are saturated solutions. Using known concentration data for saturated solutions of precursors in supercritical solvents, the saturated solutions can be diluted to desired levels for a particular deposition, cleaning process, or other treatment of a wafer work surface. Formation of a saturated solution or diluted solution, and delivery of these solutions to a supercritical reactor are performed under supercritical conditions. A supercritical reactor is charged with supercritical fluid prior to introduction of the solution of the precursor. Dilutions can be performed in a number of ways. Additionally, recirculation apparatus allow for efficient formation of solutions of precursors as well as allowing for more reliable control of flow conditions and ultimately uniformity of deposited layers, cleaning processes, or other supercritical fluid treatments of the wafer.

Preferably apparatus as described in relation to FIGS. 1A–D below are made of materials that can withstand the high pressures associated with supercritical fluid processing as well as the corrosive nature of such processing fluids. In some cases, strong acids or bases may be used with supercritical solvents to perform a particular process. Preferably, apparatus of the invention include components that are made of at least one of hastalloy, stainless steel, inconel, and the like.

FIG. 1A depicts a simplified block depiction of an apparatus, 100, for generating supercritical solutions of solid precursors. Apparatus 100 has an inlet 101 for introduction of a supercritical solvent (dark arrows indicate flow path of supercritical fluid). Inlet 101 branches into two lines, each with a one-way valve (e.g. a check valve), 107, followed by a particle filter, 109. Each of the branches of line 101 then feed into vessels 103 that are charged with a solid precursor 105. The supercritical solvent passing over the solid, dissolves at least some portion of the solid to make a solution of the precursor. A large surface area of the solid is preferable to achieve this end. In a preferred embodiment, an excess of precursor 105 is used and the vessels dimensioned in such a way so that when the supercritical solvent passes through vessels 103, a saturated solution of the precursor is formed. One-way valves 107 are provided in the lines so that any pressure buildup in the vessels (due for example to the dissolution process) does not push solution back through the lines toward the supercritical fluid inlet. This ensures unidirectional flow of the system.

The precursor solution exits vessels 103, passes through additional filters 111, and one-way valves 113, before reconverging at an outlet 115. Filters 111 prevent any solid particles from entering outlet 115. Such particles can interfere with a deposition process, filters prevent particles from entering a downstream reactor or lines that supply such a reactor. One-way valves 113 are provided in the lines primarily so that either of vessels 103 can be changed out and recharged, while the other vessel is being used to form solutions of the precursor. Thus vessels 103 may take the form of modular "cartridges."

In one embodiment, the solution provided by outlet 115 is introduced directly into a supercritical reactor that itself is charged with a supercritical fluid (thus forming a diluted form of the solution). Alternatively, the solution is introduced into a reactor recirculation loop of which includes the reactor fluid volume. Also alternatively, the solution is diluted via a dilution mechanism, and then introduced into the reactor or introduced into a reactor recirculation loop as described.

Figure 1B:
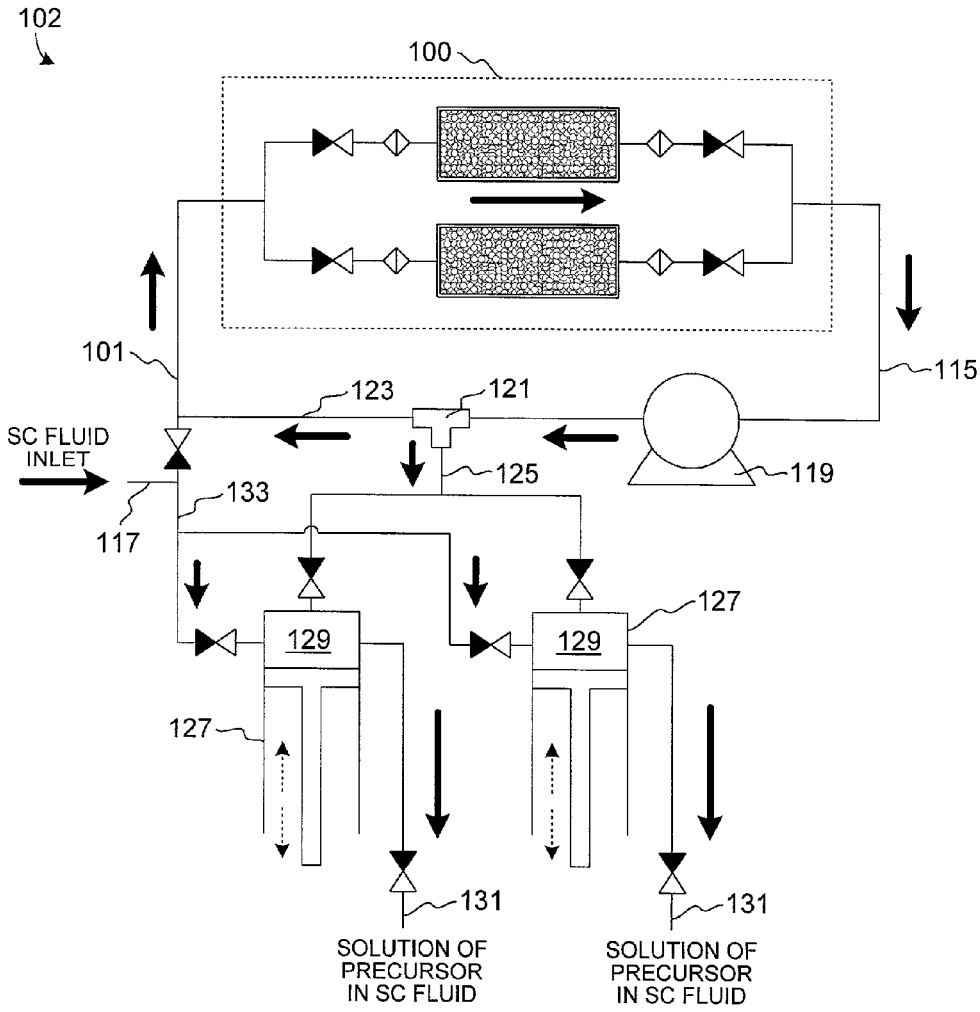

FIG. 1B depicts a simplified block depiction of an exemplary apparatus 102, used to generate either concentrated or diluted supercritical solutions of dissolved solid precursors and deliver them to a supercritical system. Communicating with apparatus 102, is apparatus 100, as just described in relation to FIG. 1A (shown within dotted line 100 in FIG. 1B). Thus, apparatus 100 is a component of apparatus 102 in this example, and for simplicity apparatus 100 will herein be referred to as "generator 100."

Apparatus 102 has a supercritical fluid inlet, 117, which branches in order to supply two lines, line 101 (the inlet for generator 100), and line 133. As described, generator 100 provides a solution of a precursor to outlet 115, preferably a saturated solution. In some cases, the saturated solution can be formed by a "one-pass" flow of supercritical fluid through generator 100. The saturated solution passes through pump 119, and then into valve 121. Valve 121 can direct solution solely into line 125 for introduction into syringe pumps 127 (one-way valves are provided on the branches of line 125 to ensure no back flow from the syringe pumps). Alternatively, valve 121 can direct precursor solution solely into line 123 for recirculation through generator 100, ensuring that a saturated solution is formed. As mentioned, in one embodiment, generator 100 is used as a "one-pass" system for forming a solution of a precursor; the solution being delivered via valve 121 directly to syringe pumps 127. In another embodiment, supercritical fluid is circulated through generator 100 (via valve 121) until saturation is reached. Thus, this sub-system of apparatus 102 as described serves as a generator recirculation loop. When valve 121 is switched to allow the saturated solution to flow into syringe pumps 127, flow through line 123 (and thus the generator recirculation loop) ceases, but flow continues through generator 100 via inlet 117 and feed line 101. A continuous flow through generator 100 is maintained in order to prevent the dissolved precursor from precipitating out of solution due to a pressure drop.

As mentioned, line 133 is also supplied with supercritical fluid via inlet 117. Line 133 branches to supply precursor-free supercritical fluid to syringe pumps 127 (one-way valves on the branches of line 133 are provided to ensure no back flow from the syringe pumps). Also, because the branches of supply line 133 are valved, in some cases supercritical fluid can be introduced into the volume, 129, of syringe pumps 127 in order to mix with the saturated solution of precursor (provided via line 125) and thus form diluted solutions of the precursors.

The volume 129, or capacity, of syringe pumps 127 is formed by the relative position of the syringe plunger in the syringe barrel. Thus, when the plungers of syringe pumps 127 are retracted (movement indicated by dotted line arrows), supercritical solution is drawn into volume 129. As described, concentrated solution can be drawn in, neat supercritical fluid, or both, depending on the valve configuration. Predetermined amounts of each fluid can be drawn in to make precursor solutions of precise concentration. Valve configurations also allow independent operation of each of the syringe pumps. Once a syringe is filled to the desired capacity with a solution of desired concentration, the plunger is engaged and the solution is pushed out of the syringe and delivered to outlets 131. One-way valves on supply lines 125 and 133 prevent back flow into those lines. One-way valves on outlets 131 prevent back flow into syringes 127. Since syringe pumps 127 can function independently, one can be changed out or serviced, while the other is being used to form or deliver solutions of the precursor.

Figure 1C:
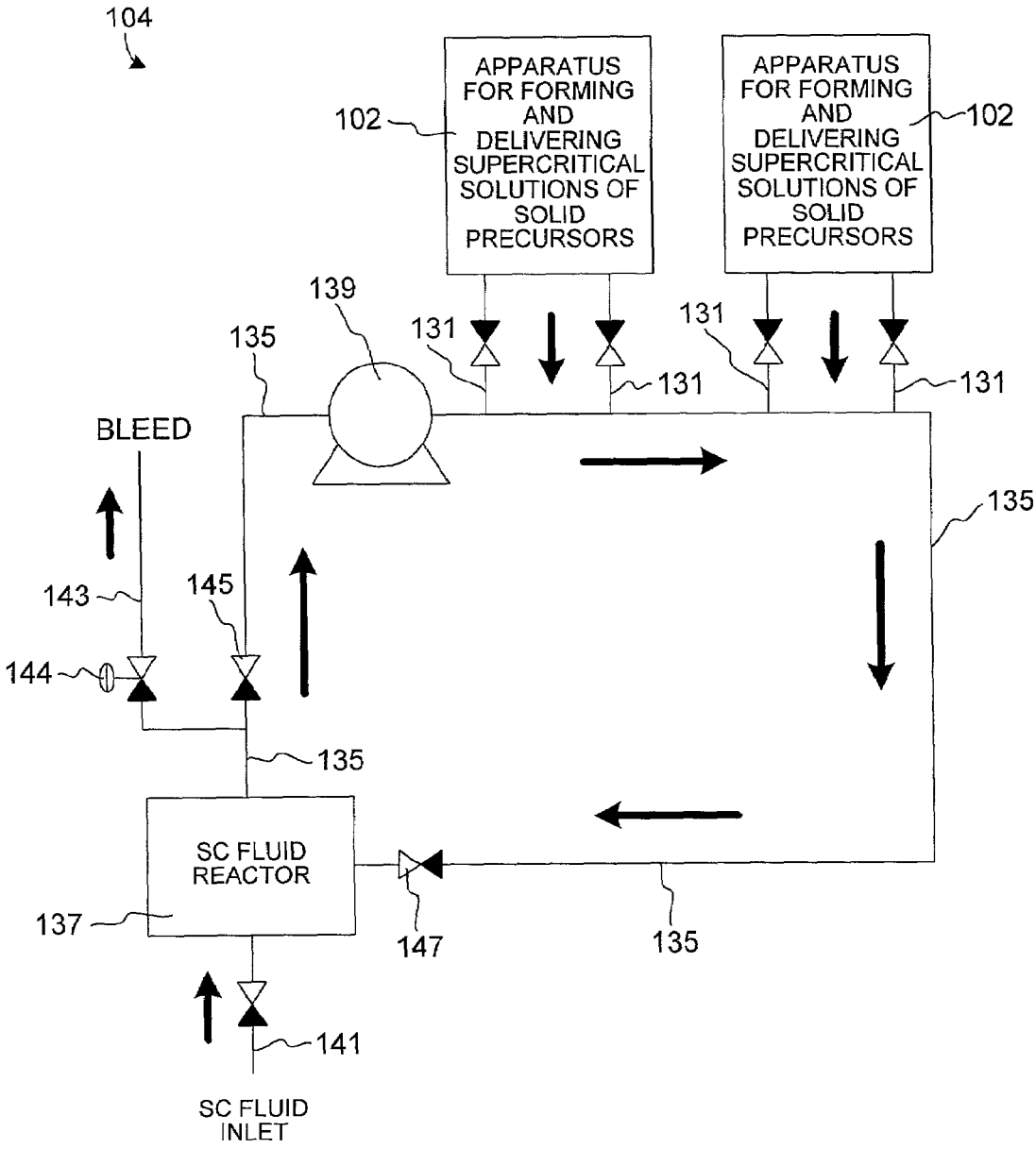
FIG. 1C depicts a simplified block diagram of an apparatus for delivering supercritical solutions of solid precursors to a reactor, showing an example of how the generators of FIGS. 1A–B feed into the system.

As mentioned apparatus 102, for forming supercritical solutions of solid precursors, can be used to deliver such solutions directly to a supercritical reactor or alternatively, to a reactor recirculation loop that supplies such a reactor. FIG. 1C depicts an apparatus, 104, for introducing supercritical solutions of solid precursors into a supercritical reactor. Apparatus 102 (as described in relation to FIG. 1B) are used as components of apparatus 104 to deliver supercritical solutions of solid precursors (via outlets 131) to a reactor recirculation loop 135 (the four legs of line 135 are indicated). In this case, there are two such apparatus 102 supplying the reactor recirculation loop. This not only decreases downtime due to the service needs of a single apparatus 102, but also allows simultaneous delivery of diverse precursors and supercritical fluids to the reactor system. In this way, many treatment scenarios are realized, depending on the chemistry of the application, be it a cleaning regimen or a multi-step deposition process. For example, one apparatus 102 can be used to deliver a first solid monomeric precursor in solution form and another apparatus 102 can be used to deliver a second solid monomeric precursor. Once the two precursors are delivered to a reactor, a co-polymerization reaction can be initiated to deposit a co-polymeric film on a wafer. In another example, one apparatus 102 is used to deliver a first precursor for deposition of a film on a wafer, and a second apparatus 102 is used to deliver a second precursor for deposition thereon.

Once precursor solutions are delivered to line 135, they traverse line 135 in the direction of fluid flow (as indicated by the dark arrows) and are delivered to supercritical fluid reactor 137 which is part of the reactor recirculation loop. The solution flows through reactor 137 and continues through line 135 to pump 139, which actively pumps the solution through the system, circulating it through line 135 and reactor 137. Preferably, supercritical fluid flows through the system at between about 50 and 200 ml per minute. Reactor 137 preferably has at least a temperature-controlled wafer stage, but may also have temperature-controlled walls in a process cavity (where a wafer or wafers are held during processing). For example the reactor may have a heated stage.

Additionally there is a supercritical fluid inlet, 141, supplying reactor 137 directly, as well as a bleed line 143 and bleed valve 144 for venting the system. Also there is a one-way valve 145, downstream from bleed line 143, and a one-way valve 147, upstream from reactor 137.

Thus one way to introduce a supercritical solution of precursor to the reactor (and perform a deposition for example) is to charge the entire reactor recirculation loop (line 135 and reactor 137) with precursor-free supercritical fluid via inlet 141, and then introduce a supercritical solution of precursor via apparatus 102. By knowing the volume of the loop and the concentration of the solution of precursor, a final concentration of precursor solution in the loop is calculated.

Valves 145 and 147 allow isolation of the chamber from the recirculation loop. Once a precursor solution (of desired concentration) is in the reactor and loop, the reactor can be isolated from the loop before performing the deposition. Thus precursor can be deposited (e.g. a copper salt is reduced to form copper metal on a heated wafer) only within the reactor and not in line 135 of the recirculation loop.

Reactor 137 may have its own fluid agitation system, such as an internal magnetic stirring device. Once an "isolated" deposition as described above (or cleaning process) is complete, bleed valve 144 can be opened (while valves 145 and 147 are still closed) and inlet 141 opened to allow supercritical fluid to flush the reactor of remaining unwanted precursor. In this way, the precursor solution remaining in line 135 can be used for subsequent processes. If the same process is to be repeated, once the reactor is cleaned and vented and the wafer removed, the reactor is recharged with supercritical fluid via inlet 141. Then valves 145 and 147 are reopened to allow circulation of the supercritical fluid through the reactor recirculation loop. In this example, apparatus 102 is used to meter into the reactor recirculation loop, the appropriate amount of precursor solution to re-establish the desired concentration of precursor for another deposition. Thus, having a reactor recirculation loop reduces overall consumption of supercritical fluid, since only the reactor volume need be vented in most cases. As well, there is a concomitant reduction in charging and bleed time, which in turn reduces cycle time.

Again referring to FIG. 1C, in an alternative embodiment, a precursor solution is circulated through the reactor via the reactor recirculation loop during a deposition or other wafer treatment. For example, reactor 137 contains a wafer pedestal capable of heating the wafer. A heat-sensitive deposition precursor is circulated through the system while the wafer is heated. In this case, deposition of the precursor occurs only on the heated surface of the wafer; the precursor solution is free to circulate the system without depositing material on any other surface of the reactor recirculation loop.

The reactor recirculation loop allows for efficient mixing of precursors between deposition reactions, and in the case of a cleaning operation, provides agitation (flow) of supercritical media over the work surface of a wafer. Apparatus 104 may be used in a flush. For example, inlet 141 and bleed valve 144 are used with valves 145 and 147 open in order to flush the entire loop (including the reactor) of dissolved precursor material after a deposition.

Figure 1D:
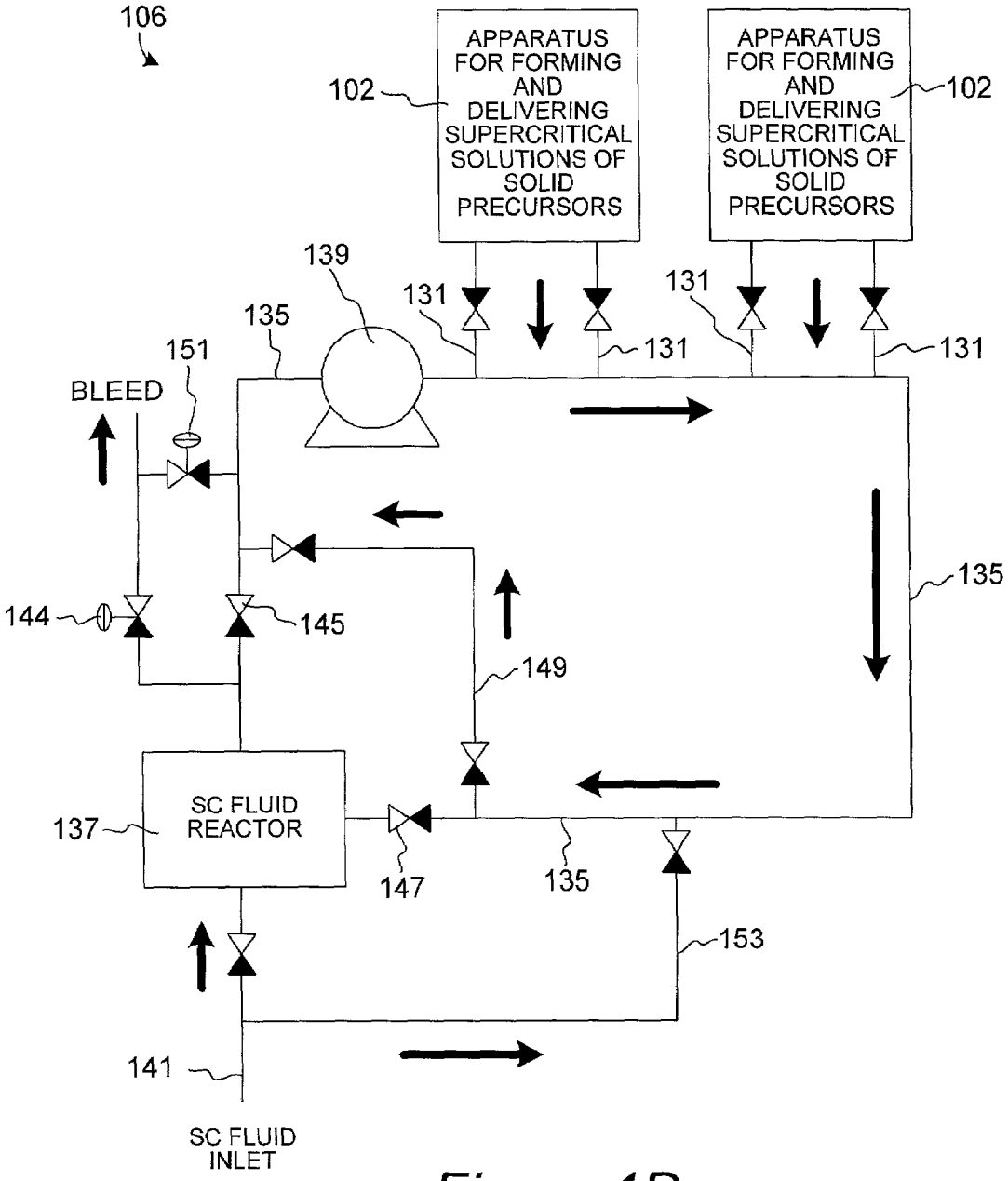
FIG. 1D depicts a simplified block diagram of another apparatus for delivering supercritical solutions of solid precursors to a reactor.

FIG. 1D depicts a system, 106, even more flexible than apparatus 104, for introducing supercritical solutions of solid precursors into a supercritical reactor. Apparatus 106 is essentially the same as apparatus 104, but with the addition of a by-pass line 149, an additional bleed valve 151 (and bleed line), and inlet line 153. By-pass line 149 is connected to the reactor recirculation line 135 upstream and downstream from reactor 137. By-pass line 149 is equipped with one-way valves at each of the junctions with line 135. In this way, if valves 145 and 147 are shut off, and fluid allowed to flow through line 149, the reactor is by-passed and supercritical fluid can circulate through lines 135 and 149 without flowing through reactor 137. In this way, not only can reactor 137 be isolated and vented (for example for wafer exchange between processes), but also precursor solution can be circulated through lines 135 and 149 at the same time.

Thus with reactor 137 isolated from circulation through apparatus 106, a by-pass recirculation loop, comprising lines 135 and 149, is engaged. With the addition of inlet 153 (which feeds line 135 upstream from the inlet of line 149) and bleed valve 151 (which can vent line 135 downstream from the outlet of line 149), the by-pass recirculation loop can be flushed with precursor-free supercritical fluid independent of the state of reactor 137 (charged or not). One exemplary application of this capability is to charge the reactor with a precursor solution (as described in relation with FIG. 2C), isolate the precursor solution in reactor 137, and perform a deposition. Concurrent with the deposition, the by-pass recirculation loop (including lines 135 and 149) is flushed of the first precursor, charged with a second precursor, and the solution circulated. Once the deposition is complete, independent of the events in the by-pass recirculation loop, reactor 137 is vented, and charged with precursor-free supercritical fluid. Then a second deposition is performed on the wafer using the second precursor by reconfiguring the circulation pattern to once again include reactor 137 (i.e. the reactor recirculation loop). This allows the solution of the second precursor to mix with the precursor-free supercritical fluid in the reactor (and typically, but not necessarily equilibrate via recirculation through the system), exposing the wafer to the second precursor.

Figure 2A:
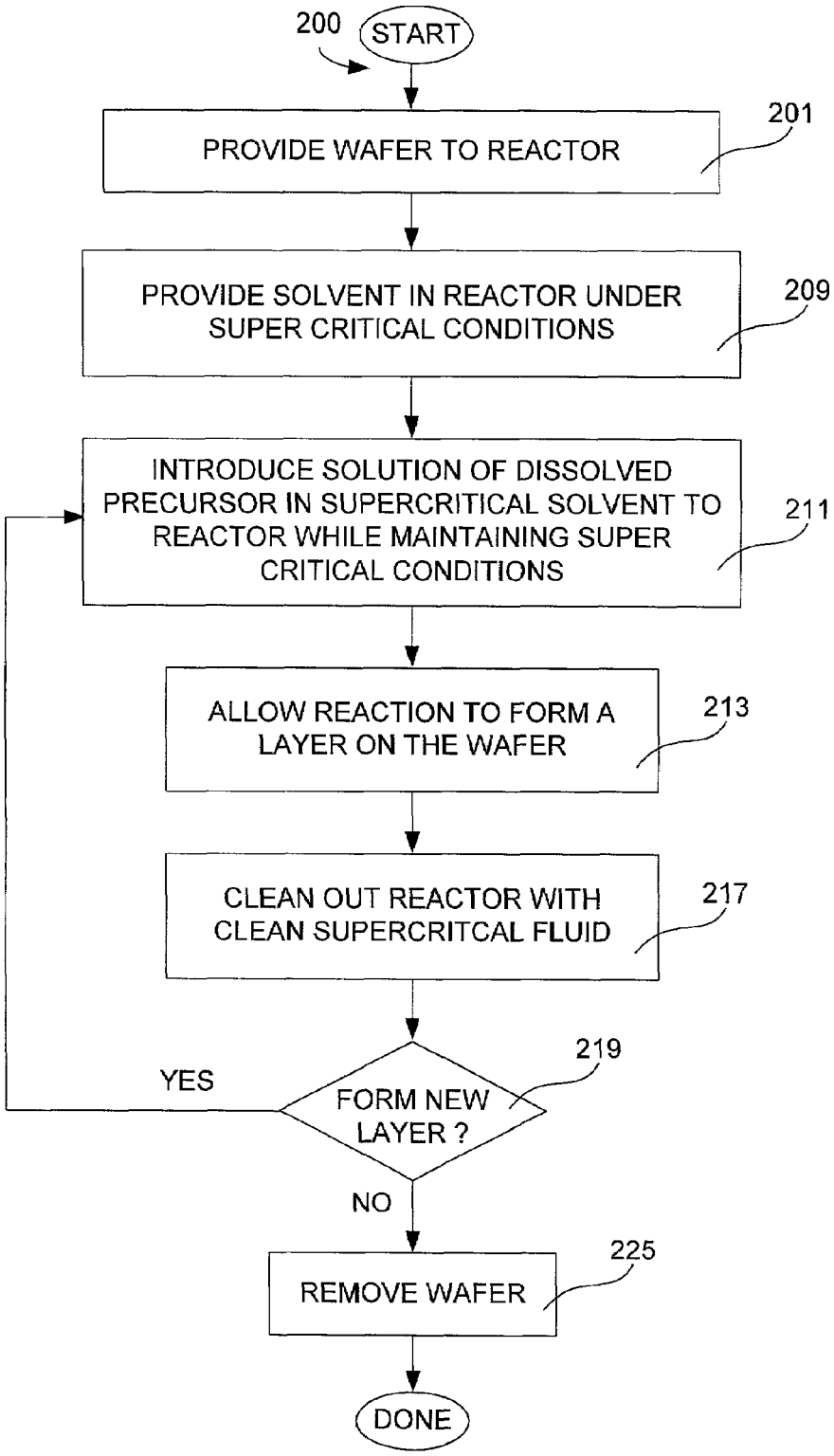
FIG. 2A is a flow chart that depicts aspects of a deposition process flow in accordance with the invention.

Thus, in accordance with the invention, FIG. 2A depicts aspects of a process flow, 200, to dissolve a solid precursor in a supercritical fluid and deliver the precursor solution to the wafer in order to deposit the precursor as a layer on the wafer. Methods of the invention may include more or less aspects of this process flow.

Preferred layers for integrated circuit fabrication include but are not limited to a diffusion barrier, a conductive metal, a dielectric, an antireflective, an etch stop, a photoresist, a resistive, and an adhesion-seed layer. As described above, more than one such layer can be applied using methods and apparatus of the invention. As an example, when copper is used as a conductive route material patterned in dielectrics, typically a diffusion barrier is first applied to a dielectric material to inhibit diffusion of the subsequently deposited copper layer into the dielectric sub-layer. In conjunction with FIG. 2A, an exemplary method of first depositing a diffusion barrier on a wafer, and then a copper layer thereon in a Damascene processing scenario will be described in relation to FIGS. 2B–E which depict cross-sections of a wafer substrate produced using such methods.

Figure 2B:
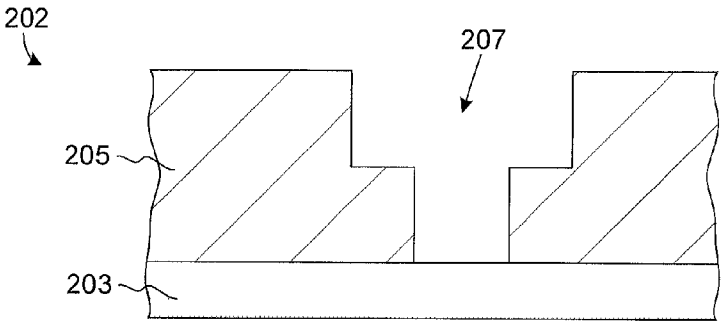
FIGS. 2B–E depict cross-sectional views of a portion of a wafer substrate in accordance with the process flow described in the flow chart of FIG. 2A.

First, a wafer is provided to a supercritical reactor. See 201. An exemplary portion of such a wafer, 202, is depicted in FIG. 2B. Wafer 202 has an underlying copper conductive route 203 and a dielectric layer 205. Dielectric layer 205 has a plurality of surface features, for example feature 207, etched into it. Preferably dielectric layer 205 is made of POSS-materials. Preferably the POSS-materials include at least one of octavinyl-POSS, methacrylfluoro-3-POSS, and methacrylfluoro-13-POSS. Description of POSS-materials and methods for depositing POSS solid precursors on wafers to form dielectric layers using supercritical media are described in U.S. patent application Ser. No. 09/727,796 by Van Cleemput et al. entitled, "Dielectric Films with Low Dielectric Constants," which is herein incorporated for all purposes.

Next, a solvent is provided to the reactor under supercritical conditions. See 209. In a preferred embodiment, this is done by first introducing the solvent under non-supercritical conditions; and then transitioning to supercritical conditions in the reactor. Examples of suitable supercritical solvents for use with this invention include supercritical forms of at least one of carbon dioxide, ammonia, water, ethanol, ethane, propane, butane, pentane, dimethyl ether, hexafluoroethane, and mixtures thereof. One particularly preferred solvent is supercritical carbon dioxide.

Next a solution of a solid precursor dissolved in a supercritical solvent is introduced to the reactor, while maintaining supercritical conditions. See 211. Then the precursor is deposited on the wafer. Typically this is through a chemical reaction, for example a reduction reaction, involving the precursor. See 213. As described above in relation to apparatus of the invention, the deposition reaction may be performed while the supercritical media is circulating through a reactor circulation loop, or not.

Figure 2C:
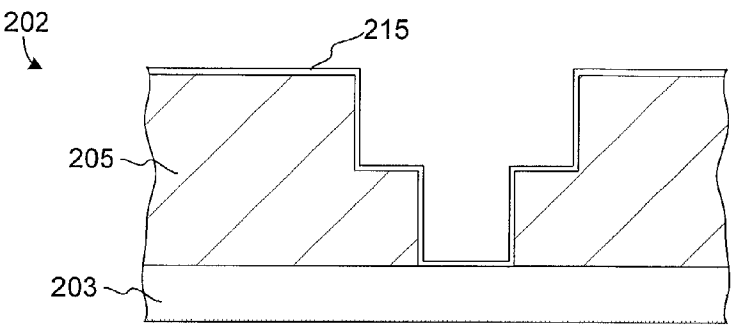

Referring to FIG. 2C, a conformal diffusion barrier 215 has been deposited on the dielectric. Preferably the diffusion barrier material includes at least one of tantalum, tantalum nitride, titanium, titanium nitride, tungsten, tungsten nitride, cobalt, nickel, indium, tin, platinum, palladium, ruthenium oxide, and ruthenium. In order to deposit such materials, preferably a precursor material is delivered to the wafer and then converted to one of the diffusion barrier materials listed above. Preferably, such precursors will include at least one of cobalt(II)acetonylacetonate, cobalt(II)tetramethyl-heptadionate, and tantalum(V)tetraethoxide-2,4-pentadionate.

After the formation of conformal barrier layer 215, the reactor is cleaned out. See 217. This may be performed as described above in relation to apparatus of the invention. Next, a decision is made whether or not to form a new layer on the wafer. See 219. If so, then steps 211–217 are repeated for another precursor to deposit a layer on top of diffusion barrier 215. As mentioned, it is preferable to deposit a copper layer thereon.

Figure 2D:
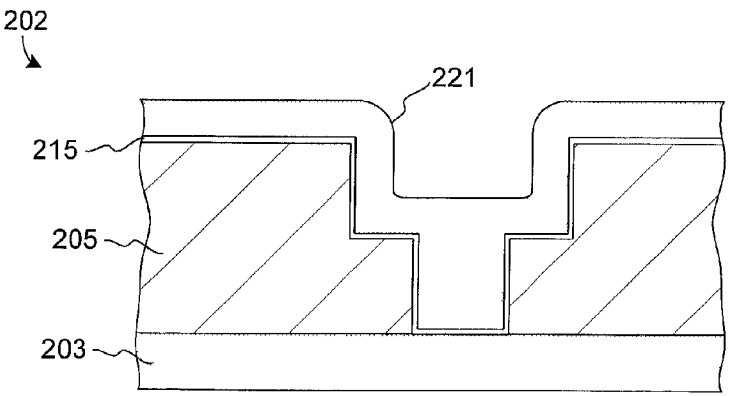
Figure 2E:
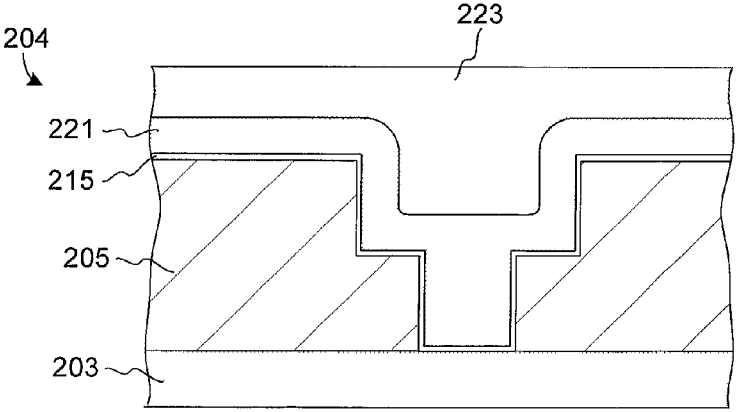

FIG. 2D shows the result when a copper layer, 221, is deposited using a precursor in supercritical fluid, for example copper(II)tetramethylheptadionate in supercritical carbon dioxide. Preferably the dissolved precursor will include at least one of copper(II)tetramethylheptadionate, copper(II)trimethyloctanedionate, and copper(II)formate. Such depositions provide excellent coverage of the wafer surface, and obviate the need for PVD seed layer and subsequent "bottom up" electrofill paradigms. Copper layer 221 fills the bottom-most via of feature 207 and most of its trench. As such, bulk electrofill (rather than intricate bottom up type processes) can be used to complete the fill of the features, or alternatively another supercritical fluid mediated copper deposition can be employed. The result of such processes is depicted in FIG. 2E. Copper layer 223 is deposited on top of copper layer 221 to a point sufficient for subsequent planarization of the metal back to the field dielectric. Referring again to decision block 219, if no further layers are to be deposited on the wafer, the reactor is cleaned, vented, and the wafer removed. See 225.

Although various details have been omitted for clarity's sake, various design alternatives may be implemented. Therefore, the present examples are to be considered as illustrative and not restrictive, and the invention is not to be limited to the details given herein, but may be modified within the scope of the appended claims.

What is claimed is:

1. An apparatus for providing a solid precursor to a surface of a work piece via a supercritical solution, the apparatus comprising:

a plurality of vessels for housing the solid precursor and allowing it to contact a solvent under supercritical or near supercritical conditions to generate a saturated solution of the solid precursor, wherein supercritical condition exist when the temperature and pressure of a solution are at or above the solution's critical temperature and pressure, and wherein near supercritical conditions exist when the reduced temperature and pressure of a solution are both greater than 80% of their critical point but the solution is not yet in the supercritical phase;

a generator recirculation loop in fluid communication with the plurality of vessels and allowing the saturated solution of the solid precursor to recirculate through the plurality of vessels, said saturated solution being under supercritical or near supercritical conditions over its entire recirculation path; and a delivery mechanism adapted to deliver, under supercritical or near supercritical conditions, a portion of the saturated solution to a reactor for housing said work piece;

wherein the solid precursor is a solid at or about standard temperature and pressure.

2. The apparatus of claim 1, wherein the delivery mechanism comprises a plurality of syringe pumps.

3. The apparatus of claim 2, further comprising a dilution mechanism for diluting the saturated solution with said solvent under supercritical or near supercritical conditions to produce a diluted solution of the solid precursor for delivery to the reactor.

4. The apparatus of claim 1, wherein the work piece is a partially fabricated integrated circuit.

5. The apparatus of claim 1, wherein the generator recirculation loop comprises a pump for providing fluid flow and a valve for causing at least some fraction of the solvent to circulate through the plurality of vessels housing the solid precursor to ensure production of the saturated solution.

6. The apparatus of claim 3, wherein the dilution mechanism also comprises the plurality of syringe pumps.

7. The apparatus of claim 3, wherein the dilution mechanism comprises a source of supercritical solvent for supplying the plurality of syringe pumps.

8. The apparatus of claim 3, further comprising a reactor recirculation loop configured to allow recirculation of the diluted solution trough the reactor under supercritical or near supercritical conditions.

9. The apparatus of claim 8, further comprising a first fluid inlet, in fluid communication with the reactor, for supplying supercritical fluids to the reactor, and a first bleed valve, located downstream from the reactor.

10. The apparatus of claim 9, further comprising a by-pass line configured to allow isolation of the reactor from the reactor recirculation loop, thus forming a by-pass recirculation loop.

11. The apparatus of claim 10, further comprising a second fluid inlet, in fluid communication with the by-pass recirculation loop, for supplying supercritical fluid directly to the by-pass recirculation loop.

12. The apparatus of claim 11, wherein the second fluid inlet comprises a secondary feed line which feeds from the first fluid inlet.

13. The apparatus of claim, 12 further comprising a second bleed valve, located downstream from the reactor and the first bleed valve.

14. The apparatus of claim 8, wherein the reactor recirculation loop provides flow of the diluted solution through the reactor at between about 50 and 200 ml per minute.

15. The apparatus of claim 1, wherein components of the apparatus comprise at least one of hastalloy, stainless steel, and inconel.

* * * * *